United States Patent [19]

Schnabel et al.

[11] Patent Number: 4,834,871

[45] Date of Patent: May 30, 1989

[54] MAGNET BLOCK ARRANGEMENT HAVING AN OUTWARDLY-DIRECTED FIELD

[75] Inventors: Hans G. Schnabel, Bornheim; Karl-Heinz Unkelbach, Cologne; Marlene Marinescu; Nicolae Marinescu, both of Frankfurt, all of Fed. Rep. of Germany

[73] Assignee: KHD Humboldt Wedag AG, Fed. Rep. of Germany

[21] Appl. No.: 113,477

[22] Filed: Oct. 28, 1987

[30] Foreign Application Priority Data

Oct. 31, 1986 [DE] Fed. Rep. of Germany ..... 3637200

[51] Int. Cl.[4] ..... B03C 1/00

[52] U.S. Cl. ..... 209/219; 209/220; 209/222

[58] Field of Search ..... 209/219, 220, 222

[56] References Cited

U.S. PATENT DOCUMENTS

| | | | |
|---|---|---|---|
| 3,365,599 | 1/1964 | Brzezinski et al. | 210/222 |
| 3,392,432 | 7/1968 | Naumann | 209/219 X |
| 3,455,276 | 7/1969 | Anderson | 209/219 X |
| 3,737,822 | 6/1973 | Buus et al. | 209/219 X |
| 4,199,455 | 4/1980 | Estabrook | 209/219 X |

FOREIGN PATENT DOCUMENTS

| | | |
|---|---|---|
| 2832275 | 2/1980 | Fed. Rep. of Germany . |
| 3238052 | 4/1984 | Fed. Rep. of Germany . |

*Primary Examiner*—Joseph J. Rolla
*Assistant Examiner*—David H. Bollinger
*Attorney, Agent, or Firm*—Hill, Van Santen, Steadman & Simpson

[57] ABSTRACT

A magnetic separator comprising a rotatable drum including an axis of rotation and a periphery comprising a plurality of magnet blocks. The magnet blocks are mounted and arranged as circular rings about the axis of rotation. The ith magnet block is magnetized in a predetermined direction defined by $\psi_i = -n\rho_i$ where n is a positive number and $\phi_i$ is an angle described by a line from the center of gravity of the ith block to the axis of rotation and a predetermine radius vector. The spacing between neighboring centers of gravity of the magnetic blocks, expressed as a sector angle, is smaller than or equal to about $\pi/2$ (n+1).

14 Claims, 7 Drawing Sheets

MAGNET BLOCK ARRANGEMENT HAVING AN OUTWARDLY-DIRECTED FIELD

BACKGROUND

1. Field of the Invention

The present invention relates to a magnetic separator containing magnetic blocks which are magnetized in a drum uniformly and perpendicularly relative to the axis of the magnetic separator.

2. Description of the Prior Art

Such magnetic separators are utilized for dry-field or wet-field separating wherever a field that can be generated with permanent magnets is adequate. In drum-type magnetic separators, the magnetic field is stationary and the product to be separated is moved over a region of the drum as disclosed in the German application No. 32 38 052 A1, and the German allowed application No. 28 32 275.

The force for separating magnetic from unmagnetized particles in the dry-field and wet-field separation depends on the absolute quantity and on the gradients of the magnetic field strength. A maximally-high, maximally-uniform magnetic field strength is generally a favorable pre-condition. However, the range is also critical for the performance of a magnetic separator, this being essentially dependent on the field gradients and, among other things, having influence on the maximum grain size of the product to be separated.

U.S. Pat. No. 3,365,599, fully incorporated herein by this reference, has proposed to improve the magnetic flux in the outer region of a magnetic drum in that the interspaces of radially-magnetized segments (the north poles and south poles of the magnetic separator) be partially bridged by magnet blocks magnetized in the circumferential direction. The magnetism "wasted" due to the mutual de-magnetization is thereby also supposed to be capable of being exploited. However, it is not true, as occasionally maintained, that the "overall magnetism is conducted into the work region of the drum" as a result thereof.

SUMMARY OF THE INVENTION

The object of the present invention is to maximize the field strength in the outer region of drum-type magnetic separators, whereby a matching of the mineral composition to the grain distribution of the particle mix to be separated must be established, i.e. a field strength distribution in the outer region of the drum which is optimum under the respective number of poles required can be achieved.

The above object is achieved in a magnetic separator of the type generally set forth above in that the magnet blocks are arranged in the manner of a circular ring, with reference to the axis of the magnetic separator and the $i^{th}$ magnet block is magnetized in the direction $\psi_i = -n\phi_i$, whereby n is a positive number and $\phi_i$ is the angle that is described by the connection of the center of gravity of the $i^{th}$ magnet block with the axis of the magnetic separator and an arbitrary, but fixed, radius sector, $\psi_i$ is to be counted in the same rotational sense and proceeding from the 0 angle position as $\phi_i$ and the distance between two neighboring centers of gravity of the blocks, expressed as a sector angle, is smaller than $\pi/2(n+1)$.

Advantageous improvements will also be set forth below, the teaching of the present invention holds true for all magnet blocks which are arranged around the axis of the drum-type magnet separator in the manner of a circular ring, whereby n is an arbitrary, positive number, preferably a whole number, as long as the magnet blocks are not distributed over the full circumference; in the latter case, the restriction applies that n must be a whole number. In a modification of the present invention, the magnetization direction of all magnet blocks in the integrated condition is identical; formally, this case could be considered as $n=0$.

Since no forces should act insofar as possible in the axis direction of the magnet separator, the field strength description is simplified to a planar configuration perpendicular to the axis of the separator. Only magnetic field components in such a plane are referred to below.

What is meant by a radius vector is an arbitrary direction (perpendicular to the axis of the drum-type magnetic separator). Illustrated with reference to a clock, for example, the hour hand can be in the 12 o'clock position. When this inherently arbitrary radius vector has been defined once, the angle $\phi_i$ and the angle $\psi_i$ for every i is always referred to this radius vector in the same rotational sense (in the clockwise direction or in the counter-clockwise direction) and proceeding from the same 0 position (for example, 12 o'clock).

The identification of the angle $\psi_i$ is tailored to the center of gravity of the $i^{th}$ block; this is meaningful because the magnet blocks are uniformly magnetized insofar as possible and already have radial symmetry. The drum diameter is thereby of no consequence, rather only the direction relative to the center of gravity. The radius relative to the center of gravity of the block i should preferably be the same. It has been shown that the field distribution in the outer space of the magnetic separator of the invention is still considerably better than in the known apparatus even when the condition $\psi_i = -n\phi_i$ is not absolutely observed and the angle $\psi_i$, for example, deviates from the reference position by 3°–5° in the case of individual blocks.

In the magnetization of the $i^{th}$ block, of course, it must be exactly known how this block will be integrated in the magnetic separator. Otherwise, the direction $\psi_i$ is independent of the size of the magnet block itself, whether a neighboring magnet block is adjacent or whether distances are present between the magnetic blocks, how such magnetic material is contained in a block, how wide (sectorial) or long (radial) it is, this, of course, having influence on the de-magnetization of this block and to be taken into consideration when building a magnetic separator. Despite the possibilities of adaptation to the desired number of poles or to the remanence of the material and other parameters of magnetic separators, however, the magnetization of the magnet block must fundamentally occur based on the afore-mentioned condition $\psi_i = -n\phi_i$.

Even manufacturing reasons of the individual magnet blocks already go to the point in favor of embodiments having high symmetry. It is generally beneficial to make the magnet blocks of identical size; the cross section can thereby be preferably rectangular, trapezoidal or can also be a sector portion of an annular ring. The radial extent of a magnet block influences the maximum field strength which is all the higher the more magnetic material is present in suitable form. For economical reasons, however, the magnetically-best, but most-expensive solution at the same time will rarely be selected. Therefore, for example, it is beneficial to execute the magnet blocks as sectors up to the axis of the magnetic separator. The improvement yielded by the sectorial filling of the interior of the magnetic separator, however, is not balanced by the added costs for the magnetic material in comparison to a magnet block which is constructed only as a segment of a more or less broad circular ring.

Frequently, it is likewise not necessary that the magnet blocks abut one another. Although the magnetic field becomes smaller when distances are present between the magnet blocks in the circumferential direction, an adequate field can nonetheless be frequently achieved therewith and the saving in magnetic materials, which has already become possible as a result thereof, yields an economic advantage over known magnetic separators without such interspaces. The gaps between the blocks should optimally not exceed 30% of a magnet block (as a sector angle or, respectively, as annular area).

The number of poles is determined by the selection of the n and with the sectorial expanse of the magnet system. When the magnet blocks are uniformly distributed over the entire surface, the n must be a whole number; $n=2(n+1)$ poles (north and south poles) then derive. When the magnet blocks sweep a sector $\alpha$, $\alpha/180(n+1)$ poles are present, whereby poles need not necessarily lie at the edges of the magnet blocks dependent on the selection of the angle $\alpha$.

The rule $\psi_i=-n\phi_i$ can be observed for every drum radius and for every product to be separated; although an attentuation of the magnetic field must be accepted in the definition of the field gradients due to the unavoidable demagnetization, the field strength nonetheless reaches the highest value still possible. There is also a degree of freedom in the definition of the number $i_{max}$, i.e. of the number of magnet blocks (given a desired number of poles); the field in the outside space of the magnetic separator becomes all the more uniform the higher the number $i_{max}$. The de-magnetization of the magnetic blocks, however, is again determined by the aforementioned formula and cannot be further improved. The width of a magnet block should preferably not be greater than $\pi/2(n+1)$ (as a sector angle). With reference to a quandrant of the magnetic separator, a range for $i_{max}$ from 4–8 is preferred. A range between 3–5 is preferred for n.

In known magnetic separators, the individual magnet blocks are secured on a foundation of soft iron, this being intended to effect that the field is pressed from the interior of the drum more towards the outside. Given the magnetic separator of the present invention, the field lines are hardly present in the interior of the magnetic separator; however, it is also expedient here to mount the magnet blocks on a ring of soft iron, particularly when the interspaces between the blocks are provided, because assembly is thereby simplified.

Two types of arrangements for the magnet blocks are particularly preferred. The sectorial arrangement over a sector of an angle $\alpha$, preferably from 70°–160°, and the annular arrangement. The first of the configurations is utilized in the "classic" drum-type magnetic separator where a rotating drum rotates about a stationary magnet system, whereby various modifications with respect to the delivery and discharge are known. The second type, the "full ring magnetization", can be utilized, for example, in conveyor belts wherein a belt runs over the drum and a sorting effect corresponding to the magnetizability of the conveyed goods is achieved upon discharge. Here, n must be a whole number.

A special case of the desired field distribution of the invention is achieved when the magnetization direction of the magnet blocks is identical (in their built-in condition). It is thereby not critical whether the magnet system is distributed over the full drum circumference, or merely fills out a sectorial region. It should cover a sector width of at least $\pi/2$ overall. There is thereby only one respective north pole and south pole lying exactly opposite one another. Formally, $n=0$ could be allocated to this special case of the magnetization.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

The object of displacing the field into the outside space, as far as physically possible, under the given circumstances (number of poles and type of magnetic material, quantity) is achieved in all examples. In FIGS. 1, 2, 3, 5, 6 and 7, five poles should be present within a sectorial range of $\alpha=150°$.

Figure 1:
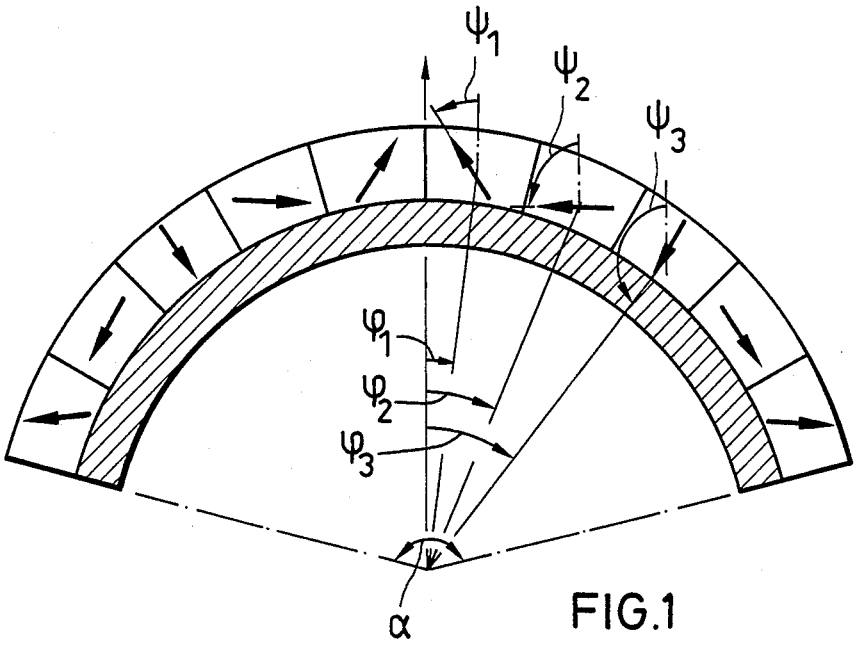
FIG. 1 is a schematic representation of a sectorial arrangement of 10 magnet blocks with $n=4$ without spacing.

FIG. 1 illustrates how the $i^{th}$ magnet block is to be magnetized (reference to the heavy arrow), whereby the direction $\psi_i$, of course, refers to the angle of the built-in magnetic field of the $i^{th}$ magnet block. The field should optimally have no components perpendicular to the plane of the drawing. The 12 o'clock position has been assumed here as a radius vector which is initially freely selectable, but to which all angles should then refer. The positive counting direction here is in the clockwise direction.

Figure 2:
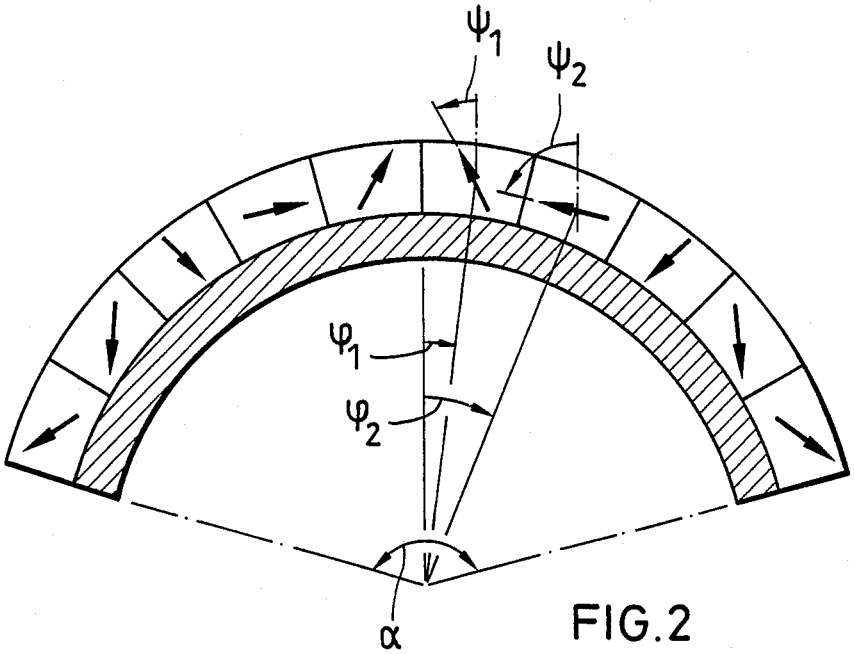
FIG. 2 is a schematic representation of a sectorial arrangement of 10 magnet blocks with $n=3.5$ without spacing.

Another possible, magnetization of the 10 magnet blocks, according to the present invention, is distributed over an angle $\alpha$ of 150°, as shown in FIG. 2. Here, the number n is defined as 3.5, i.e. not a whole number. A pole that is pronounced as in FIG. 1 does not lie at the edge of this magnet system; the field gradients are also different than in FIG. 1; nonetheless, the most suitable field distribution under these circumstances is achieved with the specified magnetization.

Figure 3:
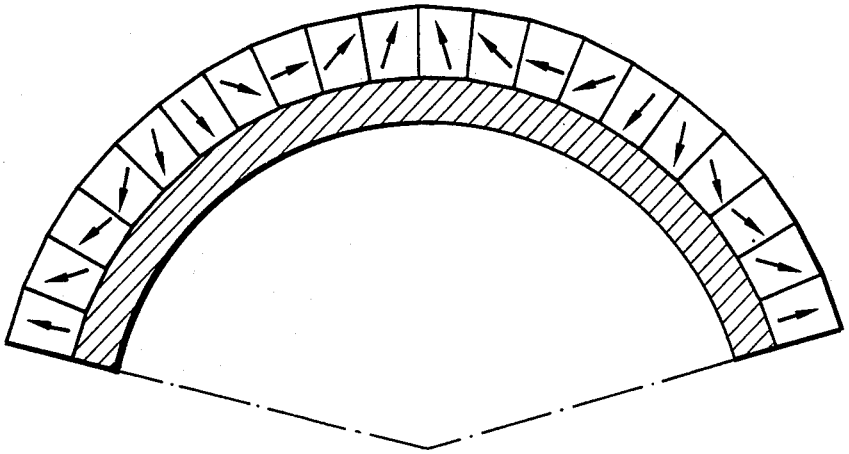
FIG. 3 is a schematic representation, doubling the number of magnet blocks without spacing given the same number of poles as in FIG. 1.

The number of magnet blocks was doubled with respect to FIG. 3 for the same angular range and given the same number of poles (n=4) as in FIG. 1.

Figure 4:
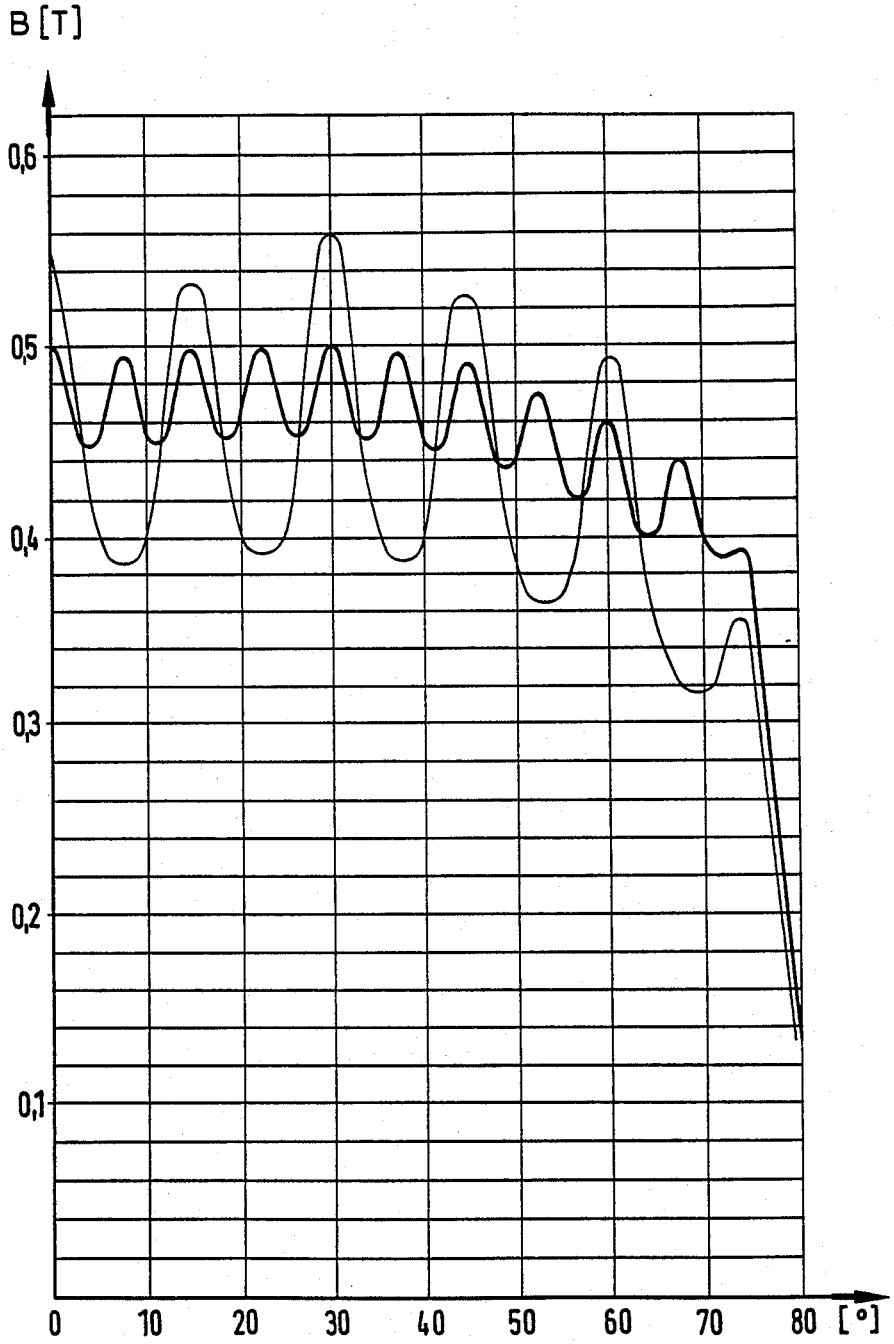
FIG. 4 is a schematic representation of the flux density over the circumferential angle given an arrangement as in accordance with FIGS. 1 and 3.

The radial field distribution (shown in FIG. 4) becomes more uniform as a result of doubling the blocks (magnetized in the manner of the present invention) in FIG. 3 in comparison to FIG. 1. The distance of the magnet system from the axis is thereby of no consequence. The only thing to be promoted for comparability is that 2 magnet blocks in a configuration of FIG. 3 are composed of exactly the same amount of magnetic material as one block in FIG. 1 and that their geometry is comparable.

Figure 5:
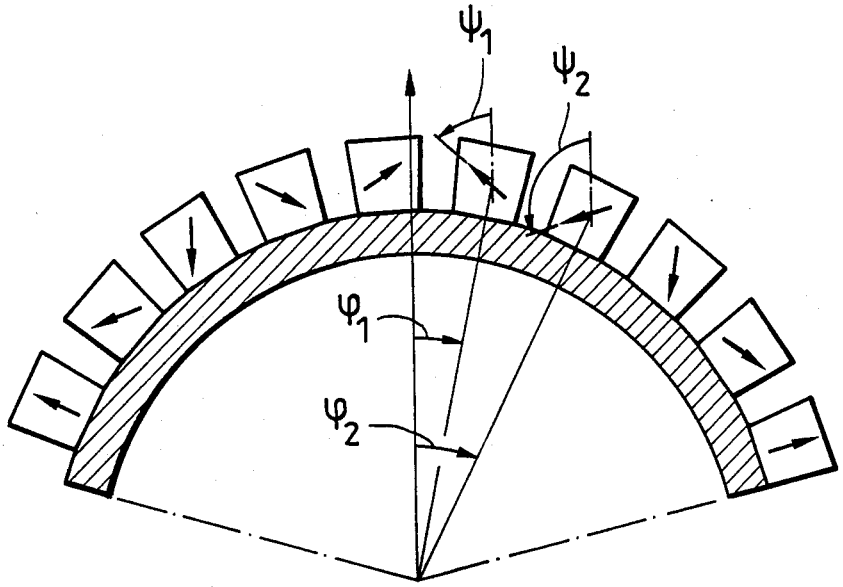
FIG. 5 is a schematic representation of a sectorial arrangement of 10 magnet blocks with spacing given the same number of poles as in FIGS. 1 and 3.

When 10 magnet blocks having n=4 are arranged having spacings from one another as in FIG. 5, the field distribution is fundamentally the same as in FIGS. 1 and 3; the maximum field strength and the uniformity are merely lower. As a result of the great field strength in the outer space, however, such a magnetic separator has an effect which is definitely comparable to known magnetic separators for whose magnet system considerably more magnetic material has been employed. In practice, the interspaces should be smaller than the magnet blocks; preferably, the angle of a "free" region should amount to at most 30% of that of a magnet block.

Figure 6:
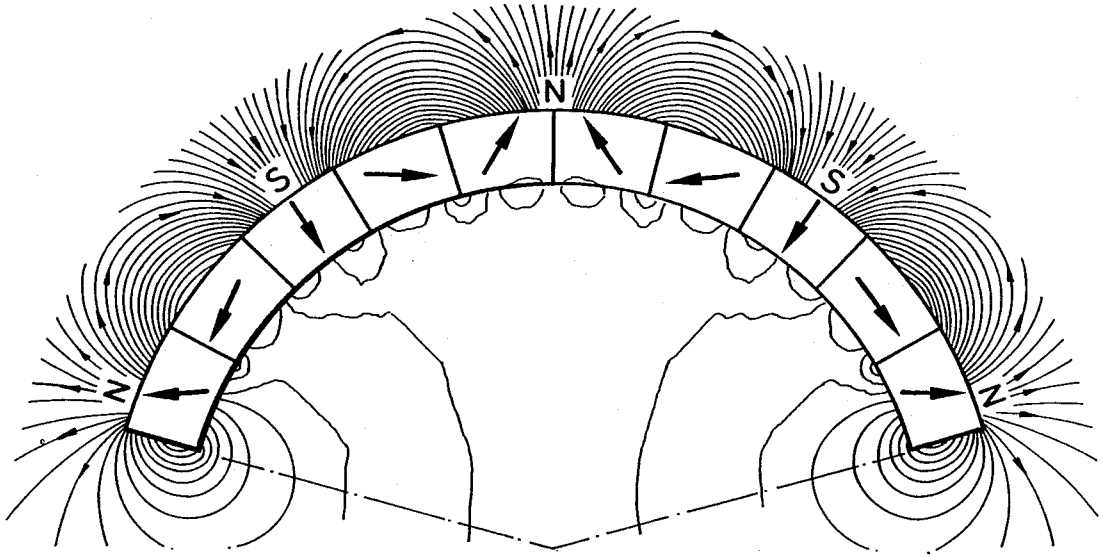
FIG. 6 is a schematic representation of the field distribution given 10 magnet blocks with $n=4$ (5 poles) without an inner soft iron foundation.
Figure 7:
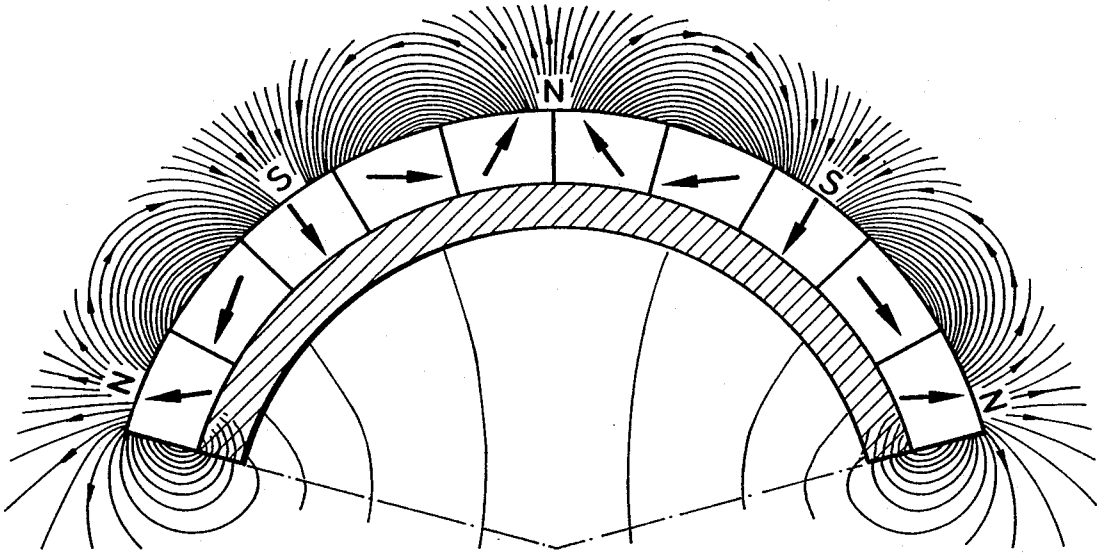
FIG. 7 is a schematic representation of a field distribution, as in FIG. 6, with inner soft core iron foundation.

The field for a magnet block arranged in accordance with FIG. 1 has been calculated and set forth in FIG. 6. One can see three north poles and two south poles in the outer region. The inner space of the drum is nearly free of magnetic fields.

When the same magnet blocks as in FIG. 1 are secured on a soft iron foundation, a significant improvement in view of the field lines (FIG. 7) no longer occurs. Such an arrangement is mainly preferred for fabrication reasons.

Figure 8:
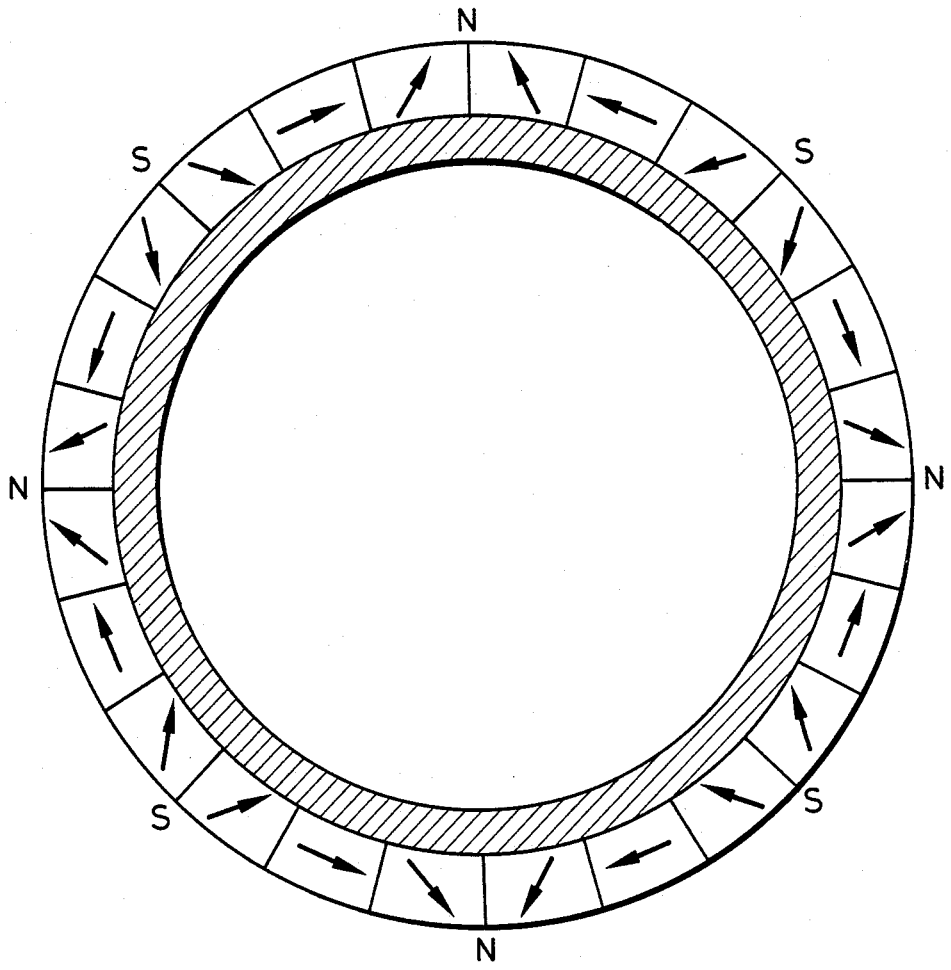
FIG. 8 is a schematic representation of an arrangement of 24 magnet blocks with $n=3$ (8 poles) without spacing on a full circle.

When the magnet blocks are to be distributed over the entire circumference of the drum in a magnetic separator, n must be a whole number. In FIG. 8, 24 magnet blocks are uniformly arranged without interspaces distributed over the entire circumference; 8 poles derive given n=3. In a magnetic separator having such a magnet system, a conveyor belt runs over 2 deflection rollers, whereby the one deflection roller comprising a rotating magnet drum and devices for collecting the various, magnetized particles are present under these rollers.

The invention also covers a boundary case comprising two poles; it can be characterized with the value n=0. Every block i of the magnetic separator thereby has the same magnetization direction (referred to a fixed spatial direction). Every individual block i is thereby differently magnetized corresponding to its different position in the magnetic separator.

Figure 9:
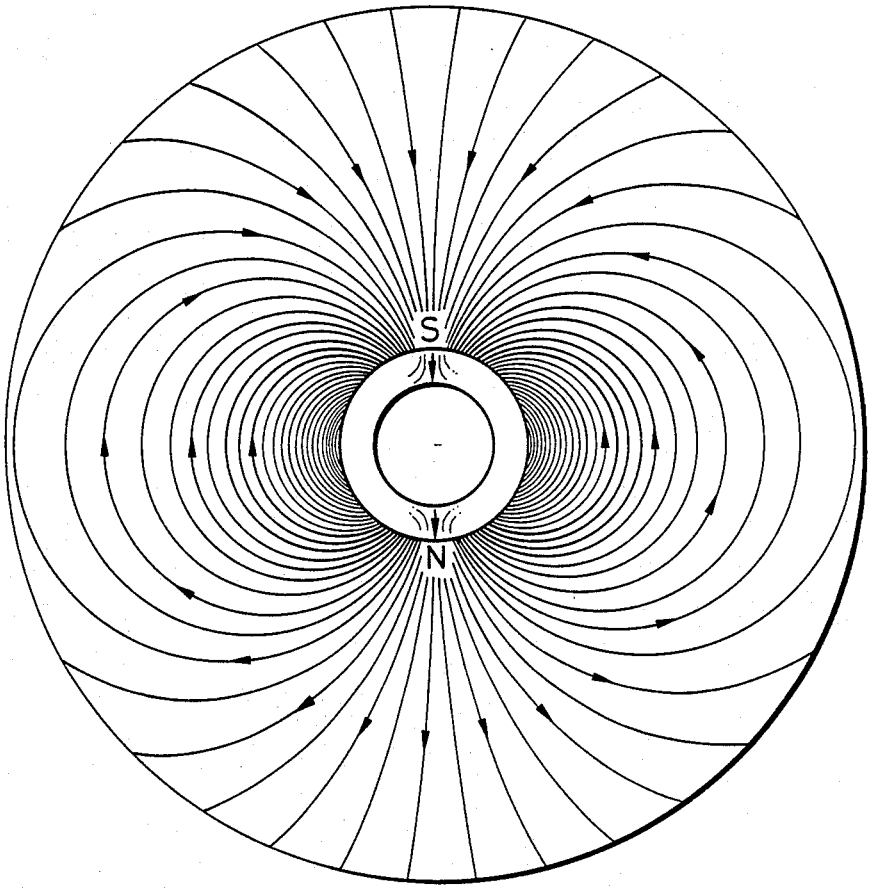
FIG. 9 is a schematic representation of the field distribution given the same magnetization direction of all magnet blocks ($n=0$).

FIG. 9 illustrates the calculated field distribution for two "tubular half-shells". Similar to the case in FIGS. 5 and 6, the actual flux course deviates from the "reference course" of the thick arrow due to the de-magnetization. Regardless of whether the magnet system is composed of two tubular half-shells or, respectively, of 8 inventively magnetized "tubular octant-shells", the desired effect is always achieved. A maximum field distribution in the outside region given a practically field-free inside space is achieved.

Although we have described our invention with reference to particular illustrative embodiments, many changes and modifications of the invention may become apprarent to those skilled in the art without departing from the spirit and scope of the invention. We therefore intend to include within the patent warranted hereon all such changes and modifications as may reasonably and properly be included within the scope of our contribution to the art.

We claim:

1. A magnetic separator, comprising:

a rotatable drum including an axis of rotation and a periphery comprising a plurality of magnet blocks, each magnet block having a center of gravity, the magnet blocks being mounted and arranged as circular rings about said axis of rotation; wherein:

$i^{th}$ magnet block being magnetized in a predetermined direction $\psi_i = -n\phi_i$, where n is a positive number and $\phi_i$ is an angle described by a line from the center of gravity of the $i^{th}$ block to said axis of rotation and a predetermined radius vector, and $\psi_i$ is counted in the same rotation sense proceeding from the predetermined radius vector; and the spacing between neighboring centers of gravity of said magnetic blocks, expressed as a sector angle, is smaller than or equal to about $\pi/2(n+1)$.

2. The magnetic separator of claim 1, wherein:

said magnet blocks are of identical size.

3. The magnetic separator of claim 1, wherein:

a cross section of a magnet block has the shape of a sectorial segment of a circular ring.

4. The magnetic separator of claim 1, wherein:

said magnet blocks each have a trapezoidal cross section.

5. The magnetic separator of claim 1, wherein:

each of said magnet blocks comprises a sectorial segment having a width, expressed as a sector angle, which is smaller than or equal to about $\pi/2(n+1)$.

6. The magnetic separator of claim 1, wherein:

said magnet blocks are arranged as said circular ring abutting one another and without spacing therebetween.

7. The magnetic separator of claim 1, wherein:

the individual magnet blocks are arranged as said circular ring spaced apart so as to have interspaces therebetween, whereby each interspace has a width of preferably less than half of the width of a magnet block.

8. The magnetic separator of claim 1, wherein:

said rotatable drum comprises a soft iron portion and said magnet blocks are arranged on said soft iron portion.

9. The magnetic separator of claim 1, wherein:

all of said magnet blocks are arranged within a sector; and the sector angle $\alpha$ for all magnet blocks lies between 60° and 240°.

10. The magnetic separator of claim 9, wherein:

said sector angle is between 90° and 160°.

11. The magnetic separator of claim 1, wherein:

said magnet blocks are uniformly distributed over the overall circumference of the circle and in that the number n is a whole number.

12. The magnetic separator of claim 1, wherein:

each of said magnet blocks comprises the magnetization direction which is identical among all of said magnet blocks; and the magnet system formed by said magnet blocks covers at least an overall sector range of at least $\pi/2$.

13. The magnetic separator of claim 12, wherein:

said magnet blocks are distributed over the full circumference of the circle.

14. The magnetic separator of claim 12, wherein:

said magnet blocks are distributed over at least a quadrant of the circle.

* * * * *